United States Patent [19]

Kutik et al.

[11] 4,109,832

[45] Aug. 29, 1978

[54] PUMPING SYSTEM HAVING A PRESSURE RELEASE

[75] Inventors: Louis F. Kutik, Ft. Lauderdale; Howard E. Cecil, Miami, both of Fla.

[73] Assignee: Security Plastics, Inc., Miami Lakes, Fla.

[21] Appl. No.: 795,090

[22] Filed: May 9, 1977

[51] Int. Cl.[2] ..... B67D 5/42

[52] U.S. Cl. ..... 222/318; 222/321; 222/332; 222/340

[58] Field of Search ..... 222/318, 321, 340, 341, 222/332, 375, 379–385, 496, 424, 442, 108–111, 571; 239/331, 333; 417/554

[56] References Cited

U.S. PATENT DOCUMENTS

| | | | |
|---|---|---|---|
| 2,119,884 | 6/1938 | Lohse | 222/321 X |
| 2,411,435 | 11/1946 | Kirschenbaum | 222/424 X |
| 2,741,994 | 4/1956 | Dann | 222/341 |
| 3,777,945 | 12/1973 | Nozawa et al. | 222/340 X |
| 4,034,900 | 7/1977 | Hafele | 239/333 X |

*Primary Examiner*—Robert B. Reeves
*Assistant Examiner*—Fred A. Silverberg
*Attorney, Agent, or Firm*—Oltman and Flynn

[57] ABSTRACT

A non-pulsating, non-throttling, vented pumping system with pressure release features is disclosed. This pumping system provides continuous dispensing of fluent product from a container in a relatively non-pulsating discharge which may be a stream or spray. The pumping system includes a pressurizing compartment for receiving product from the container, a manually reciprocatable actuator for withdrawing product from the container through at least one check valve into the pressurizing compartment where it can be pressurized in a pressure stroke of the actuator, a storage compartment for receiving pressurized product from the pressurizing compartment upon movement of the actuator in its pressure stroke, an outlet passageway leading from the storage compartment for dispensing pressurized product, an accumulator piston slidably reciprocatable in the storage compartment and operable to open and close the outlet passageway, a spring biasing the accumulator piston to a rest position closing the outlet passageway, and a projection on the accumulator piston operable to open the check valve just prior to the closing of the outlet passageway by the accumulator piston for relieving pressure in the storage compartment to facilitate closing of the outlet passageway by the piston. The container is vented to the atmosphere through the pump. Since the accumulator piston opens and closes the outlet passageway only when the bias of the spring has been overcome or relieved as the case may be, the pump is non-throttling as well as non-pulsating and vented.

12 Claims, 7 Drawing Figures

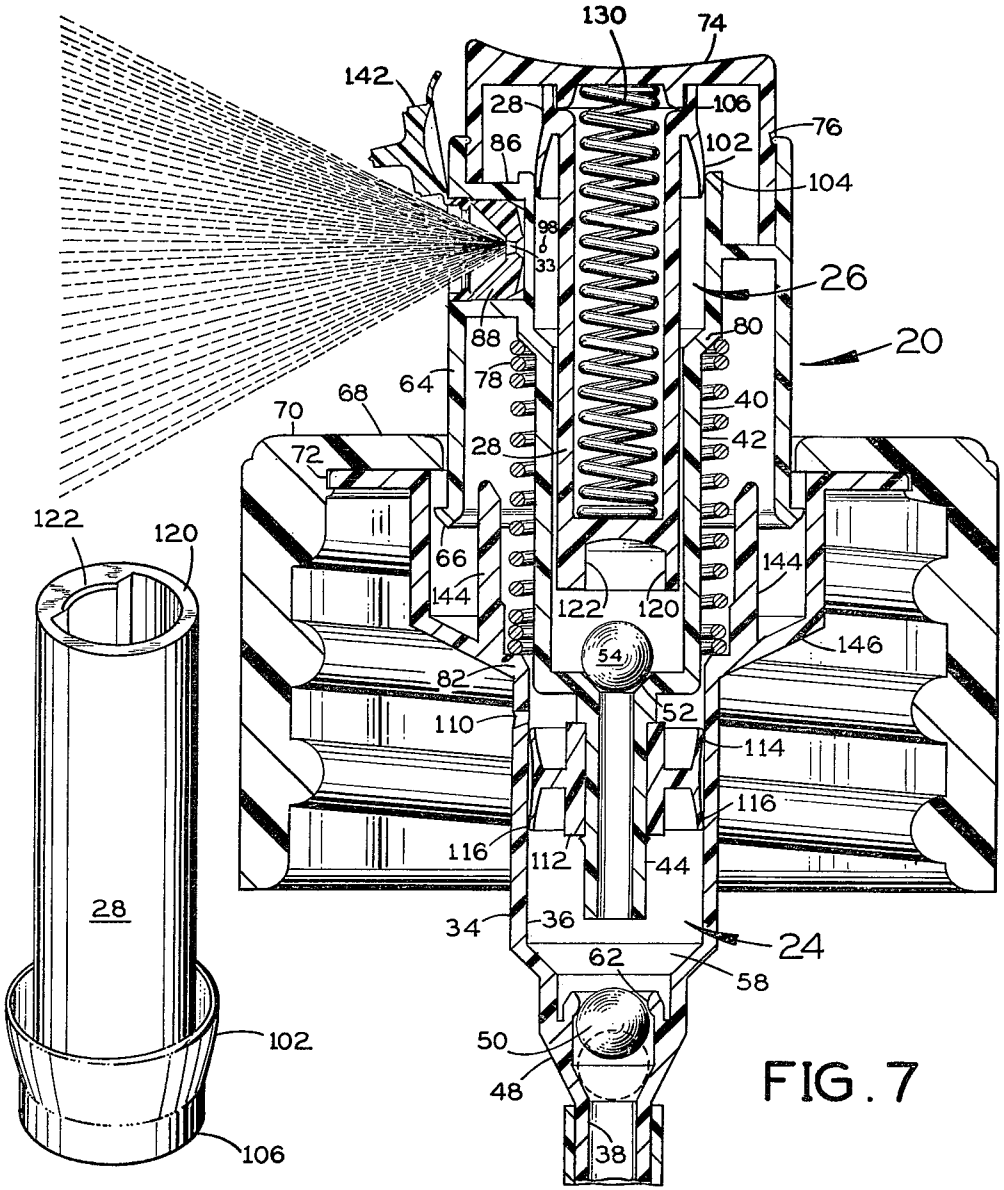
FIG. 7
FIG. 5
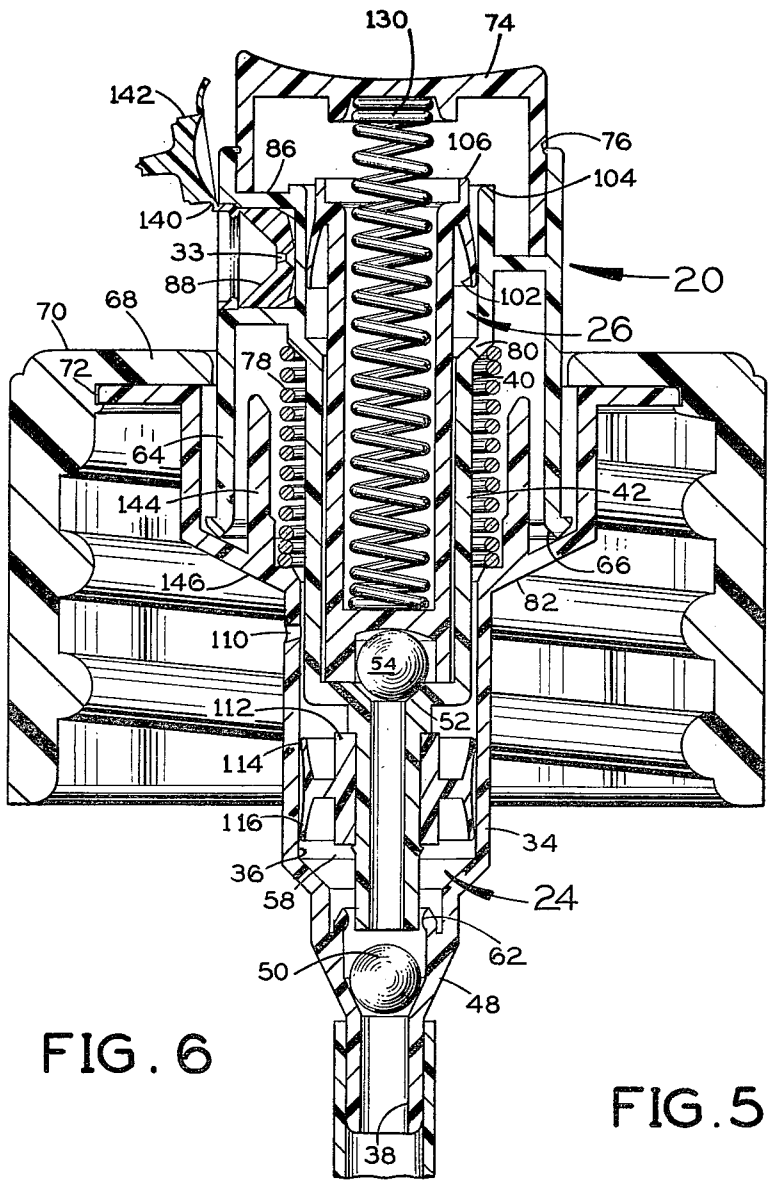
FIG. 6

PUMPING SYSTEM HAVING A PRESSURE RELEASE

RELATED APPLICATION

This invention is related to the non-pulsating, non-throttling, vented pumping system described and claimed in copending application Ser. No. 659,227 filed on Feb. 19, 1976 now U.S. Pat. No. 4,079,865 and represents an improvement thereof. Said copending application is incorporated herein by reference.

BACKGROUND OF THE INVENTION

The manually operable dispensing pump described and claimed in the above-identified copending application dispenses fluent products in a relatively non-pulsating discharge. In some applications, such as for example when pumping viscous products, there tends to be a slight dribbling of product from the outlet passageway upon termination of pumping. The pump includes a storage compartment containing an accumulator piston which opens and closes the outlet passageway in cooperation with a check valve which admits fluent product into a pressurizing compartment feeding the storage compartment but does not allow the product to return to the container during the pressure stroke of the accuator of the pump. The pressure of the fluent product in the storage compartment acts on the accumulator piston to open the outlet passageway. Upon termination of pumping, the pressure of a spring acting on the accumulator piston causes the accumulator piston to close the outlet passageway. However, since the check valve, when closed, prevents product from returning to the container, there may be enough pressure in the storage compartment to prevent the outlet passageway from being completely closed by the accumulator piston. In this case, fluent product tends to dribble adversely out the partially closed outlet passageway when pumping ceases.

SUMMARY OF THE INVENTION

The present invention provides a pumping system for continuously dispensing a fluent product in a relatively non-pulsating discharge, and features a means to relieve pressure in a storage compartment upon termination of pumping so as to allow an accumulator piston in the pumping system to completely close the outlet passageway of the pumping system without adverse dribbling of product from the outlet passageway. The pumping system includes a pressurizing compartment, a manually reciprocatable actuator for withdrawing product from a container and for pressurizing the product in the pressurizing compartment, a storage compartment for receiving pressurized product from the pressurizing compartment, an outlet passageway leading from the storage compartment for dispensing pressurized product, an accumulator piston slidably reciprocatable in the storage compartment and operable to open and close the outlet passageway, a spring biasing the piston to a rest position closing the outlet passageway, a check valve acting between the pressurizing compartment and the storage compartment to pass pressurized product from the pressurizing compartment into the storage compartment and operable to block return flow of product from the storage compartment back into the pressurizing compartment, and means on the accumulator piston operable to open the check valve just prior to the closing of the outlet passageway by the accumulator piston to facilitate closing of the outlet passageway by the piston upon termination of pumping. The opening of the check valve relieves pressure in the storage compartment by allowing that pressure to release into the pressurizing compartment when pumping is terminated. In preferred embodiments, the pumping system includes a vent which is normally closed to prevent escape of product, but which vents the container to the atmosphere during the pumping action. The particular opening and closing of the outlet passageway by an accumulator piston acting under bias makes the pump non-throttling.

Accordingly, it is an object of the present invention to provide a pumping system for dispensing product from a container in a relatively non-pulsating discharge, and for inhibiting dribbling of product from the outlet passageway of the pumping system upon termination of pumping.

Among the other objects of the invention are to provide a pumping system which equalizes pressure of products supplied to the outlet passageway; which features a vent that is closed by a pair of sealing members providing a double-acting seal for the vent opening; which features centering of springs for the internal action of the pumping system; which returns any product passing the accumulator piston to the container; and which can be manufactured by efficient mass production techniques.

Further objects and advantages of this invention will be apparent from the following detailed description of a presently-preferred embodiment thereof, which is shown in the accompanying drawings.

BRIEF DESCRIPTION OF THE DRAWINGS

FIG. 5 is a perspective view of an accumulator piston included in the pumping system and shown in an inverted position;

FIG. 6 is a vertical sectional view similar to FIG. 2 but showing the pumping system in a rest condition; and FIG. 7 is a vertical sectional view similar to FIG. 2 showing the actuator of the pumping system in its intake stroke, and dispensing stored product.

Figure 1:
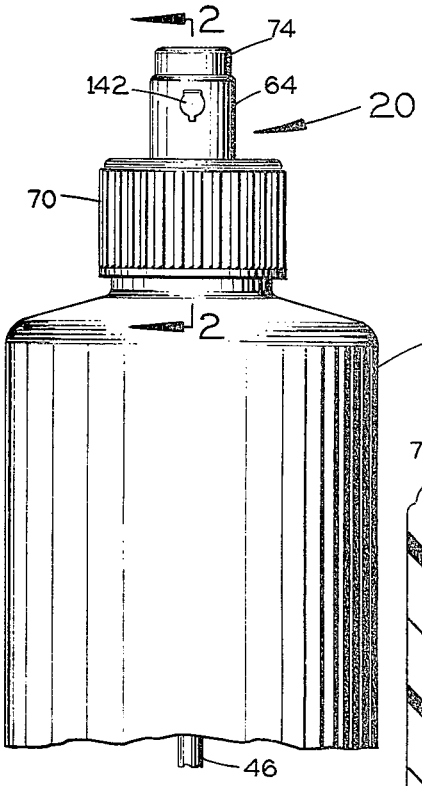
FIG. 1 is an elevational view of a pumping system on a container in accordance with one embodiment of the invention.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DETAILED DESCRIPTION

The pumping system 20 serves to dispense product from a container 22 in a relatively non-pulsating discharge. Ordinarily, the product is dispensed as a stream or spray.

The pumping system 20 includes a pressurizing pump designated generally as 24. The pumping system 20 also includes a storage compartment 26 for storing fluent product dispensed from the pump 24 under pressure, an accumulator piston 28 in the storage compartment and under bias to maintain the pressure of the stored product, an outlet passageway 32 leading from the storage compartment which is opened and closed by the accumulator piston 28, and a restricted orifice 33 included in the outlet passageway which is restricted sufficiently to allow only a portion of the product pressurized by a given pressure stroke of an actuator 35 to exhaust through the orifice, the remainder of the pressurized product being stored in the storage compartment 26 due to expansion of that compartment by upward movement of the accumulator piston 28, so that the stored product is released as a stream or spray when the actuator 35 is on its intake stroke. The actuator 35 has a relatively short stroke and can be reciprocated rapidly, such that the stream or spray need not be maintained by the accumulator piston for a long time on a given intake stroke of the actuator 35.

The pumping system 20 includes a housing 34 which has an upper annular portion 36 and a lower annular portion 38. The lower annular portion 38 forms an eduction passageway to which a dip tube 46 is attached. Dip tube extends down into the container 22 and serves to withdraw fluent product from the container on an intake stroke of the actuator 34.

Between the upper annular portion 36 and the lower annular portion 38 of the housing 34, there is a tapered portion 48 which forms the valve seat 49 for a ball 50, with the ball 50 and the valve seat 49 acting as an inlet valve for the pump 24.

The storage compartment 26 is formed by a cylinder 40 which has an upper tubular portion 42 and a lower reduced diameter tubular portion 44. Between portions 42 and 44 there is a valve seat 52 which receives a ball 54. The ball 54 and the valve seat 52 together form an exhaust valve for the pump 24. The balls 50, 54 are normally seated on their respective valve seats to close the pump.

The housing 34 forms a pressurizing compartment 58 which has the inlet ball 50 at its lower end and the exhaust ball 54 at its upper end. The tapered portion 48 of the housing 34 may have dimples or projections 62 which retain the inlet ball 50 loosely so as to allow it to open and close, and which allow the ball 50 to be snapped into place during assembly of the pump. The pressurizing compartment 58 receives a lower portion of the actuator 35 which in this embodiment is a piston, but it should be understood that the actuator 35 may be a diaphragm if desired. In addition to the cylinder 40, the actuator 35 includes an outer, annular skirt 64 with the lower end 66 which may be snapped into place under a lip 68 of a mounting cap 70 for attaching the pumping system 20 the container 22. The mounting cap 70 may be internally threaded as shown.

The lower end 66 of the skirt 64 forms a stop for preventing the actuator 35 from being removed upwardly from the mounting cap 70. The housing 34 has an upper flange 72 that is affixed to the lip 68.

The actuator 35 has an upper cap member 74 to which the skirt 64 is riveted as at 76. The actuator 35 is biased upwardly by a coil spring 78, the upper end of which engages a shoulder 80 on the cylinder 40, and the lower end of which engages a shoulder 82 on the housing 34.

The actuator 35 has a circular, hollow portion 86 which receives the nozzle 88 in which the restricted orifice 32 is formed. The nozzle 88 has a central indentation 90 which communicates by slots 94 and 96 with two openings 98 and 100 formed in the skirt 64 and communicating with the storage compartment 26. The two openings form a pair of channels for feeding fluent product in separate paths from the storage compartment to the restricted orifice 33 at equalized pressure.

The accumulator piston 28 has a circular, yieldable flap 102 which engages and is biased against the adjoining wall of the cylinder 40 to seal the accumulator piston relative to the cylinder 40 which forms the storage compartment 26. However, if any product leaks past the flap 102, it flows upwardly over the upper end 104 of the cylinder 80 into a passageway 108 which returns the overflow product back down into the pump housing 34. The upper end 106 of the accumulator piston 28 is always slightly above the upper end 104 of cylinder 40 to direct the product over the upper end 104 and into the passageway 108.

The housing 34 has a vent opening 110 which serves to vent the container 22 to the atmosphere during the reciprocation of the actuator 35. There is a sealing member 112 affixed to the lower tubular extension 44 of the cylinder 40. This sealing member 112 provides a double-acting seal for normally closing the vent opening 110, and for unblocking the opening 110 on a pressure stroke of the actuator 34 as shown in FIG. 7 so that air may flow past the end 66 and through the vent 110 into the container 22 so as to equalize pressure between the atmosphere and the inside of the container during the operation of the pump. The sealing member 112 has an upper flap 114 and a lower flap 116. The lower flap 116 provides a tight seal on pressure strokes of the actuator 35, and the upper flap 114 provides a tight seal on intake strokes of the actuator 35 for resisting the suction of the product on intake strokes. The sealing member 112 including the flaps 114 and 116, may be made of a softer material than the cylinder 40 so as to insure good sealing action. The entire pumping system is preferably made of plastic, and the sealing member 112 may preferably be made of a soft polyethylene material.

The lower end of the accumulator piston 28 is in the form of a tube 120 which has a laterally offset portion 122 for unseating the ball 54 from the exhaust valve seat 46 upon termination of pumping as shown particularly in FIG. 6. The sealing flap 102 of the accumulator piston 106 opens and closes the outlet passageway 32 by blocking and unblocking the openings 98 and 100. When the accumulator piston 28 is in the closed position shown in FIG. 6, the sealing flap 102 blocks the openings 98 and 100. When the accumulator piston 28 is in the open position shown in FIGS. 2 and 7, the flap 102 unblocks the openings 98 and 100 to allow fluent product to escape through the outlet passageway 32 and the orifice 33.

The unseating of the ball 54 occurs just prior to the closing of the outlet passageway 32 by the accumulator piston 28 during the reciprocation of the piston for relieving pressure in the storage compartment to facilitate closing of the outlet passageway by the piston. This assures that there will be no dribbling of the fluent product from the outlet passageway 32 upon termination of pumping.

The accumulator piston 28 is biased downwardly by a coil spring 130, the lower end of which engages the lower portion of the accumulator piston 40, and the upper end of which engages the cap 74.

An insert 140 may be placed in the member 86, with the insert 140 carrying a closure 142 that can be opened and closed relative to the outlet passageway 32 and the orifice 33. The closure 142, when closed prevents the orifice from becomming clogged by drying product. This is particularly useful where the product is a paint or like product.

The housing 34 has angularly spaced ribs 144 for centering the spring 78 relative to the pump body 34. The housing 34 has a tapered portion 146 for facilitating return of overflow product to the vent means 110 as has been described.

There are webs 148 for centering the upper end of cylinder 40 and ribs 150 for centering the lower end of cylinder 40.

Figure 2:
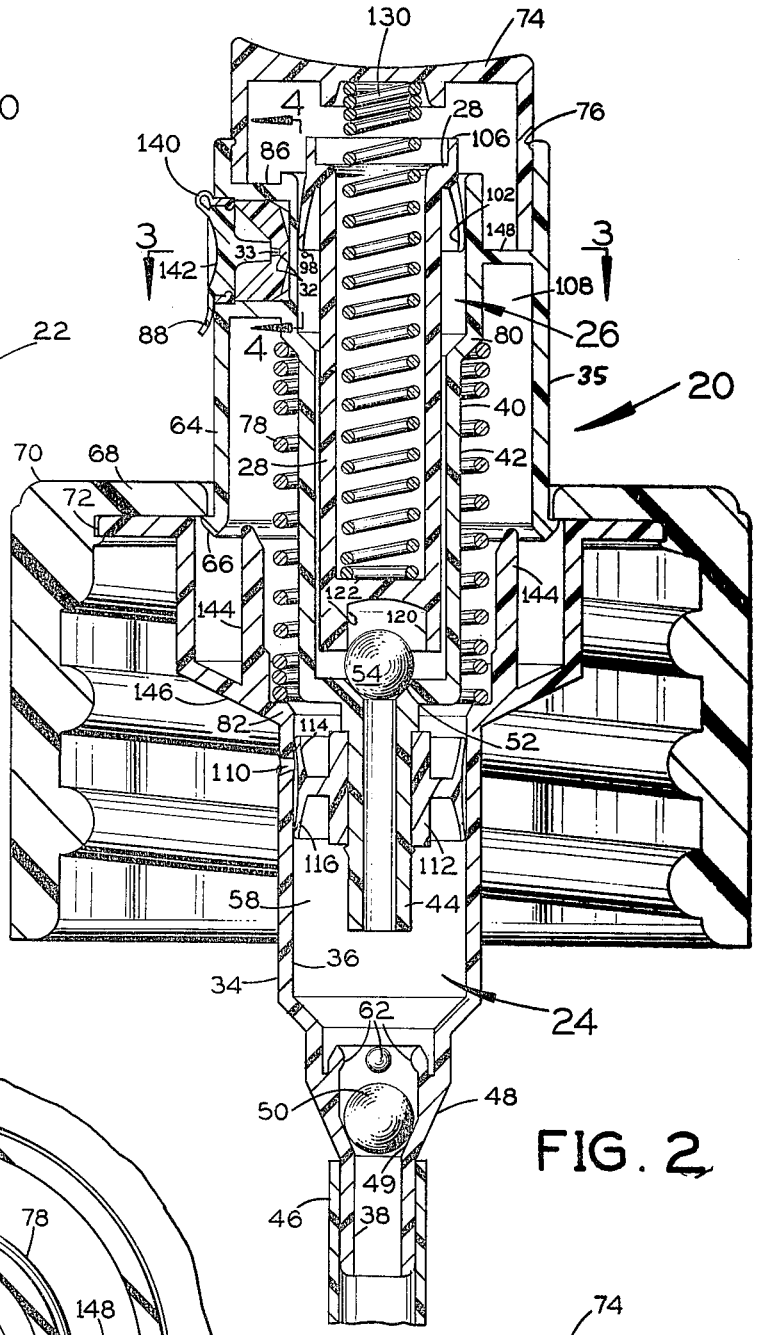
FIG. 2 is a vertical sectional view of the pumping system taken along line 2—2 of FIG. 1.
Figure 3:
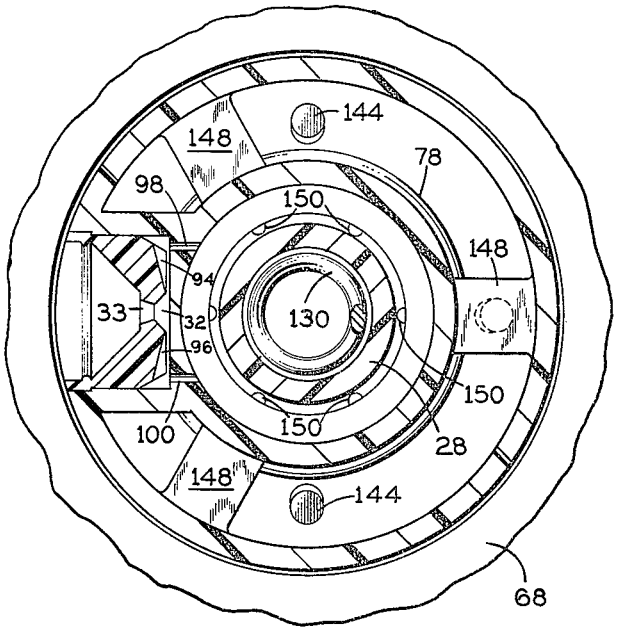
FIG. 3 is a horizontal cross-sectional view taken along line 3—3 of FIG. 2 and looking in the direction of the arrows.
Figure 4:
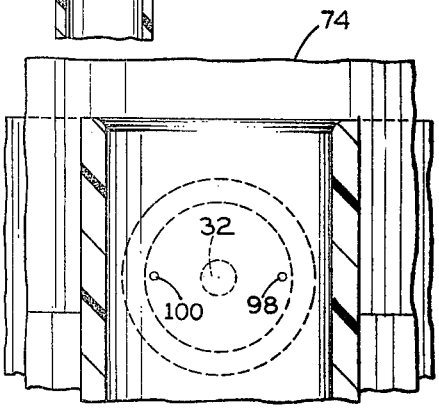
FIG. 4 is a fragmentary vertical sectional view taken along line 4—4 of FIG. 2.

In operation, the pressurizing compartment 24 receives product from the container. The actuator 35 is movable upwardly in an intake stroke to withdraw the product from the container into the pressurizing compartment and movable downwardly in a pressure stroke to pressurize the product in the pressurizing compartment. The storage compartment 26 receives pressurized product from the pressurizing compartment upon said movement of the actuator in its pressure stroke. The outlet passageway 32 leads from the storage compartment for dispensing pressurized product therefrom. The accumulator piston 28 is reciprocatable in the storage compartment and is operable to open and close the outlet passageway. The spring 130 biases the accumulator piston to a rest position closing the outlet passageway as shown in FIG. 6. The piston is movable by the pressure of product in the storage compartment against the bias of the spring 130 to open the outlet passageway as shown in FIGS. 2 and 7. The check valve 52, 54 acts between the pressurizing compartment and the storage compartment and is operable to pass pressurized product from the pressurizing compartment into the storage compartment for moving the accumulator piston to open the outlet passageway upon movement of the actuator in its pressure stroke. The check valve is also operable to block return flow of product from the storage compartment back into the pressurizing compartment upon the following intake stroke of the actuator. This action maintains the dispensing of product through the outlet passageway as long as the pressure of product in the storage compartment maintains the accumulator piston positioned to open the outlet passageway. The laterally offset projection 122 on the accumulator piston is operable to open the check valve 52, 54 just prior to the closing of the outlet passageway by the accumulator piston during the reciprocation of that piston for relieving pressure in the storage compartment to facilitate closing of the outlet passageway by the piston. This action releases pressure in the storage compartment and prevents dribbling of product from the outlet passageway upon termination of pumping.

It may be seen in FIG. 6 that when the actuator is fully depressed, the tubular extension 44 reaches the retainer projections 62 for retaining the ball 50 loosely relative to the valve seat 52. In assembling the pumping system, the ball 50 is placed on top of the projections 62 where it will rest until it is passed between the projections. There is no need to push the ball 50 between the projections with a tool, because after the pump is fully assembled, the actuator 35 may be depressed fully to the position shown in FIG. 6 so that the tubular extension 44 of cylinder 40 engages the ball 50 and pushes it between the projections 62 which yield slightly due to the resiliancy of the plastic material of which the housing 34 is made. The ball 50 passes between the projections 62 and rests on the valve seat 52. The actuator 35 then is returned to its rest position.

Having thus described our invention, we claim:

1. In a manually operated pumping system for dispensing a fluent product from a container in a substantially non-pulsating discharge, said system having mounting means for attaching it to the container and comprising:

means providing a pressurizing compartment for receiving product from the container;

manually reciprocable actuator means movable in one direction in an intake stroke to withdraw product from the container into said pressurizing compartment and movable in the opposite direction in a pressure stroke to pressurize the product in said pressurizing compartment;

means providing a storage compartment for receiving pressurized product from said pressurizing compartment upon said movement of said actuator means in its pressure stroke;

and an outlet passageway leading from said storage compartment for dispensing pressurized product therefrom;

the improvement which comprises the combination of:

an accumulator piston slidably reciprocable in said storage compartment and operable to open and close said outlet passageway, spring means biasing said piston to a rest position closing said outlet passageway, said piston being movable by the pressure of product in said storage compartment against the bias of said spring means to open said outlet passageway;

a check valve acting between said pressurizing compartment and said storage compartment, said check valve being operative to pass pressurized product from said pressurizing compartment into said storage compartment for moving said piston to open said outlet passageway upon movement of said actuator means in its pressure stroke, said check valve being operative to block return flow of product from said storage compartment back into said pressurizing compartment upon the following intake stroke of said actuator means whereby to maintain the dispensing of product through said outlet passageway as long as the pressure of product in said storage compartment maintains said piston positioned to open said outlet passageway;

and means on said accumulator piston operable to open said check valve just prior to the closing of said outlet passageway by said accumulator piston during the reciprocation of said piston for relieving pressure in said storage compartment to facilitate closing of said outlet passageway by said piston.

2. The pumping system as claimed in claim 1 in which said outlet passageway includes an orifice, and a pair of channels for feeding fluent product in separate paths from said storage compartment to said orifice at equalized pressure.

3. The pumping system as claimed in claim 1 and further including:

a housing for said compartments with said actuator means and said piston being reciprocatable relative to said housing;

said storage compartment means being in the form of a cylinder reciprocatable relative to said housing and having a rest position;

vent means including an opening in said housing to vent the container;

and seal means affixed to said cylinder for blocking said opening in the rest position of said cylinder and unblocking the opening as said cylinder reciprocates to vent the container to the atmosphere.

4. The pumping system as claimed in claim 3 in which:

said check valve comprises a valve seat formed by said cylinder and a ball normally seated on said valve seat;

and said means for opening said check valve includes a projection on said accumulator piston for unseating said ball just prior to closing of said outlet passageway by said accumulator piston.

5. The pumping system as claimed in claim 4 in which said projection is tubular with a laterally offset portion.

6. The pumping system as claimed in claim 3 in which:

said cylinder has an upper rim;

said piston also has an upper rim which is located above said upper rim of said cylinder in the rest position of said piston for causing fluent product passing said piston to overflow said rim of said cylinder;

and said cylinder has an overflow passage communicating through said housing with said vent means for returning overflow product to said container.

7. The pumping system as claimed in claim 6 in which housing has a tapered portion for facilitating return of overflow product to said vent means.

8. The pumping system as claimed in claim 3 in which said seal means include a pair of sealing members providing a double-acting seal for said opening.

9. The pumping system as claimed in claim 8 in which said seal means is made of a softer material than said cylinder.

10. The pumping system as claimed in claim 3 further including:

second spring means for urging said cylinder to a rest position;

said housing having centering means for centering said second spring means.

11. The pumping system as claimed in claim 10 in which said centering means comprises pins formed on said housing.

12. The pumping system as claimed in claim 3 in which said cylinder and said housing have cooperating means for snapping said cylinder into said housing.

* * * * *